US010386137B2

(12) United States Patent
Steimke et al.

(10) Patent No.: US 10,386,137 B2
(45) Date of Patent: Aug. 20, 2019

(54) OPERATING SYSTEM FOR SMALL CALIBER RIFLES

(71) Applicant: Sig Sauer, Inc., Newington, NH (US)

(72) Inventors: David Luke Steimke, Epping, NH (US); Bryan Charles Dustin, Strafford, NH (US); Aaron C. Sakash, Somersworth, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/720,522

(22) Filed: Sep. 29, 2017

(65) Prior Publication Data

US 2018/0164057 A1 Jun. 14, 2018

Related U.S. Application Data

(60) Provisional application No. 62/402,198, filed on Sep. 30, 2016.

(51) Int. Cl.

| | |
|---|---|
| ***F41A 3/26*** | (2006.01) |
| ***F41A 3/82*** | (2006.01) |
| ***F41A 3/30*** | (2006.01) |
| ***F41A 17/72*** | (2006.01) |
| ***F41A 17/64*** | (2006.01) |

(52) U.S. Cl.

CPC ..... *F41A 3/26* (2013.01); *F41A 3/30* (2013.01); *F41A 3/82* (2013.01); *F41A 17/64* (2013.01); *F41A 17/72* (2013.01)

(58) Field of Classification Search

CPC .. F41A 17/66; F41A 17/70; F41A 3/26; F41A 3/30; F41A 3/82; F41A 17/64; F41A 17/72

USPC ..... 42/70.08; 89/129.02, 129.01, 128, 199

See application file for complete search history.

(56) References Cited

U.S. PATENT DOCUMENTS

| | | | | | |
|---|---|---|---|---|---|
| 2,967,367 | A * | 1/1961 | Ivy | F41A 3/26 | 42/16 |
| 3,369,314 | A * | 2/1968 | Marcus | F41A 9/27 | 42/39.5 |
| 3,380,183 | A * | 4/1968 | Sullivan | F41A 3/26 | 42/75.02 |
| 3,386,336 | A * | 6/1968 | Roy | F41A 3/72 | 42/75.02 |
| 3,724,325 | A * | 4/1973 | Silsby | F41A 19/03 | 42/136 |
| 3,774,500 | A * | 11/1973 | Into | F41A 19/02 | 89/129.01 |
| 4,212,227 | A * | 7/1980 | Stewart | F41A 19/02 | 89/129.02 |
| 4,891,898 | A * | 1/1990 | Houseman | F41A 19/15 | 42/69.02 |

(Continued)

*Primary Examiner* — John Cooper

(74) *Attorney, Agent, or Firm* — Finch & Maloney PLLC

(57) ABSTRACT

A weapon system is provided. The weapon system includes a receiver and an operating group. The operating group includes a bolt at least partially housed within the receiver; an operating rod (op-rod) assembly arranged to axially translate within the bolt. The operating group also includes a carrier assembly, a bolt assembly, and a recoil assembly. The system further includes a hinge or pivot joint at a connection between the recoil assembly and the carrier assembly, a firing pin lock, an elastomeric cone interface between the bolt assembly and the receiver, a hollowed out piston, and/or tapering on the lug of the bolt assembly.

6 Claims, 12 Drawing Sheets

(56) References Cited

U.S. PATENT DOCUMENTS

| | | | | |
|---|---|---|---|---|
| 5,663,522 | A * | 9/1997 | Kuehl | F41A 19/31 42/69.02 |
| 6,634,129 | B1 * | 10/2003 | Freeman, Jr. | F41A 3/26 42/69.02 |
| 7,676,974 | B2 * | 3/2010 | Zemanek | F41A 3/40 42/69.02 |
| 7,950,178 | B1 * | 5/2011 | Landies | F41A 19/27 42/69.01 |
| 9,010,233 | B2 * | 4/2015 | St. George | F41A 5/20 42/69.02 |
| 9,683,800 | B2 * | 6/2017 | Sewell, Jr. | F41A 3/72 |

* cited by examiner

OPERATING SYSTEM FOR SMALL CALIBER RIFLES

FIELD OF THE DISCLOSURE

The present disclosure relates generally to firearms. Specifically, the present disclosure is directed to operating systems for small arms, such as semiautomatic rifles.

BACKGROUND

Firearms design involves many non-trivial challenges. In particular, projectile weapons, such as small caliber rifles, have faced a challenge to produce firearms that are more durable and have improved operational efficiency.

SUMMARY

The system and method described in the present disclosure meets one or more of the above needs by providing an operating system for small caliber rifles which may include one or more of a pivoting interface between the op-rod and the bolt carrier, a keyway for improving stability in a direction perpendicular to the direction of firing, a firing pin lock which may include a firing pin lever and a firing pin latch, a recoil assembly including a plunger and one or more plunger return springs, a tapered lug which may include an angled interface at an aft end, an elastomeric insert positioned at a cone interface, and/or a carrier assembly which may include at least a recoil assembly key slot, a firing pin lever guide slot, a firing pin retention pin, a recoil assembly rotation slot, and a harmonic cam. Firearm, as used herein, may refer to a rifle. Firearm, as used herein, may also refer to a small caliber rifle such as the SIG SAUER™ MCX or MPX. Carrier, as used herein, may refer to a bolt carrier.

In one aspect, a bolt assembly for a rifle is disclosed. In one embodiment, the bolt assembly includes a bolt having a bolt body with a distal end portion, and a lug extending radially outward from the distal end portion. The lug has an outer lug surface generally parallel to the bolt body. The lug also has lug sides and an aft portion extending between the outer lug surface and the bolt body. A cross sectional size of the lug decreases as the lug extends from the bolt body to the outer lug surface. The distal end portion of the bolt is constructed to be received by a breech-end of a barrel of the rifle.

In some embodiments, the cross sectional width is measured from a first lug side to the opposed lug side on the same lug, the cross sectional width being substantially perpendicular to the major axis of the rifle.

In other embodiments, the cross sectional width is measured from the aft surface of the lug to the forward surface of the lug, the cross sectional width being substantially parallel to a major axis of the rifle.

In yet other embodiments, a first cross sectional width between the lug sides and a second cross sectional width between the aft and forward surfaces both decrease as the lug extends from the bolt body to the outer lug surface.

In some embodiments, the outer lug surface includes a chamfer or rounding.

In another embodiment, at least one of the lug sides extends toward the bolt body at an average angle of at least 1°.

In some embodiments, at least one of the lug sides has a first sloped portion defining a first angle and a second sloped portion defining a second angle, wherein the first angle is at least 3° and the second angle is at least 1° with respect to a radius of the bolt extending to a center of the outer lug surface. In other embodiments, both lug sides have the first and second sloped portions.

In another embodiment, one or both lug sides are arcuate from the outer lug surface to the bolt body. In another embodiment, the aft portion is arcuate from the outer lug surface to the bolt body.

In another embodiment, the aft portion extends toward the bolt body at an average angle from 5° to 20° with respect to a perpendicular extending from the bore axis.

Another aspect of the present disclosure is directed to an operating system for a small caliber rifle. In one embodiment, the operating system includes a carrier assembly, a recoil assembly operatively connected to the carrier assembly and including an op-rod of the rifle, and a bolt assembly with a bolt retained by the carrier assembly. A connection between the carrier assembly and the recoil assembly is a pivoting interface.

In another embodiment, the pivoting interface is configured to decouple non-axial motion of the recoil assembly from axial motion of the carrier assembly.

In another embodiment, the pivoting interface is positioned toward a rear end of the op-rod.

In another embodiment, the pivoting interface comprises a recoil assembly rotation slot in a top surface of the carrier assembly, where the recoil assembly rotation slot has a concavely-rounded surface configured for rotation therein of a corresponding convexly-rounded extension on the recoil assembly.

In another embodiment, the pivoting interface comprises a rounded interface between the recoil assembly and the carrier assembly, where the rounded interface is configured to allow free rotation of the recoil assembly with the carrier assembly about a median plane of the small caliber rifle.

In another embodiment, the pivoting interface is configured to direct recoil energy downward and toward an aft end of the small caliber rifle.

In another embodiment, the pivoting interface is configured to reduce at least one of (i) pitch excitation of the carrier assembly, (ii) torque on the carrier assembly, and (iii) moment forces during firing of ammunition.

In another embodiment, the carrier assembly is constructed for removal of the bolt by maintaining the firing pin retention pin in connection with the carrier assembly during removal of the bolt.

In another embodiment, the operating system for a firearm includes a firing pin and a recoil assembly that includes an op-rod and a firing pin lever attached to the op-rod. The firing pin lever is configured to prevent the firing pin from moving forward to strike an ammunition primer unless a trigger is in the firing position.

In another embodiment, the firing pin lever is displaced by a hammer of the firearm in response to the trigger being pulled to the firing position, thereby allowing the firing pin to move forward.

In another embodiment, a plunger return spring is configured to bias the firing pin toward a resting state.

In another embodiment, an operating system for a firearm includes a firing pin configured to strike a primer upon depression of a trigger, where the firing pin includes a camming surface oriented so that the firing pin is biased toward a rearward resting state. The firing pin also has an aft portion defining a stop surface.

In another embodiment of an operating system for a firearm, the operating system includes a lower receiver with a recess defined in an aft portion, a carrier group with an aft end defining an aft recess; an elastomeric insert positioned between the aft end of the carrier group and the recess defined in the aft portion of the receiver, where the elastomeric insert is configured to absorb recoil forces utilizing a conical or frustoconical interface.

In another embodiment, the elastomeric insert defines a first outer and a second outer portion, the first outer portion being conical and the second outer portion being cylindrical.

In another embodiment, the aft recess in the carrier group has a frustoconical shape.

Another aspect of the present disclosure is directed to a firearm gas system including a piston defining a cavity therein, where the cavity has a volume greater than 50% of the volume of the piston, and where the piston is operatively coupled to an op-rod of the firearm.

Yet another aspect of the present disclosure is directed to a method for operating small caliber rifles. In one embodiment, the method includes securing a firing pin in a resting state engaged by a firing pin catch, pulling a trigger to disengage the firing pin catch from the firing pin, releasing the firing pin to strike a primer, and returning the firing pin to a resting state using one or more springs.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

BRIEF DESCRIPTION OF THE DRAWINGS

The drawings described herein are for illustration purposes only and are not intended to limit the scope of the present disclosure in any way.

Figure 1:
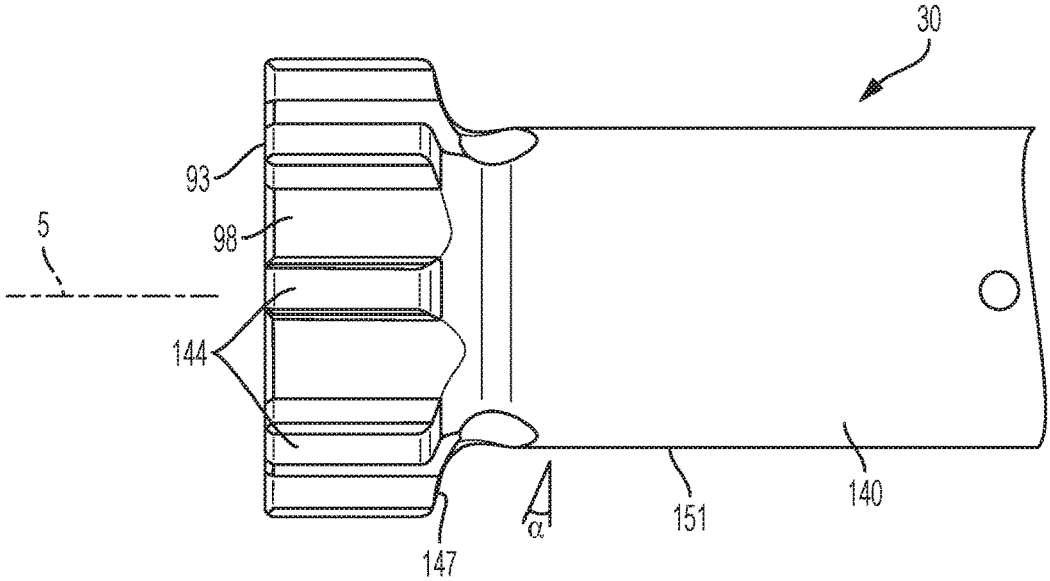
FIG. 1 illustrates a left-side elevational view of a bolt distal end portion showing a set of tapered lugs in accordance with one embodiment of an operating system for small caliber rifles of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

The following description is merely exemplary in nature and is not intended to limit the present disclosure, application, or uses.

In conventional operating systems for semiautomatic and automatic rifles, some drawbacks include frictional wear and joint failure which may result from extended use. Joints for use at a connection between a recoil assembly and a carrier assembly include, for example, dovetail joints (see FIG. 11A) that retain the recoil group generally parallel to the bolt carrier. During recoil, dovetail joints may have a large moment force applied to the structural components in the fire control group and, as a result, are subject to wear with extended use. Accordingly, it is desirable to provide an improved operating system for small caliber rifles that is more durable and less prone to component wear with extended use. As used herein, the term "small caliber" refers generally to ammunition commonly used in small arms, such as 300 BLK, 5.56×45 mm, .223 REM, 7.62×39 mm, 7.62×51, and 308 WIN to name a few examples of standard rifle cartridges. The term "small caliber" also includes pistol caliber carbines, which may be chambered in 9 mm Luger, .40 S&W, .45 AUTO and other suitable cartridges to name a few examples. The present disclosure is not limited to these examples and is contemplated for use with firearms of other calibers and ammunition types.

In firearms, a safety or safety catch is a mechanical device used to help prevent the unintentional discharge of a firearm. Safeties can generally be classified as internal safeties or external safeties. Internal safeties typically do not receive input from the user. In contrast, external safeties typically require user input, for example, by toggling a switch between "safe" and "fire." Another type of external safety in some firearms is an integral locking mechanism that must be deactivated by the user with a unique key before the gun can be fired. These integral locking mechanisms are intended as child-safety devices for use during unattended storage of the firearm—not as safety mechanisms while carrying or using the firearm.

Safety mechanisms include, for example, safety wing, action release, hammer block safety, trigger block safety, bore lock safety, grip safety, and a trigger lock safety. For example, trigger locks are an external device installed in the trigger guard that physically prevent the trigger from being pulled to discharge the weapon. Trigger locks generally have two pieces extending from either side of the lock that come together behind the trigger to obstruct the trigger movement. Trigger locks may be locked in place and unlocked with a key or combination. In order to be effective, however, trigger locks require the user to install the trigger lock in the trigger guard and place it in a locked condition. Since trigger locks require user action and are not built into the mechanical structure of the firearm itself, a trigger lock may be less likely to prevent unintentional discharge of the firearm. Also, trigger locks are generally designed to be used during firearm storage, not when the firearm is in use or carried by the user.

Another example of a safety mechanism is a lever on a trigger, or trigger safety. The trigger safety is a type of device designed to prevent unintentional discharge when the firearm is in use, such as when the firearm is carried on the user or in the user's hand. The lever must be manually depressed before the trigger can be moved to cause movement of a trigger bar to discharge the firearm. However, when the user's finger is on the trigger with the lever depressed, the firearm may still discharge unintentionally if the user's hand or body is bumped since a slight movement of the trigger may be sufficient to fire the firearm.

With semiautomatic rifles, such as rifles based on the AR-15 platform, for example, the rifle typically includes a safety switch that includes a pin extending through the receiver. The pin has a recess or flat on one side. In the "safe" position, the pin blocks the trigger from being pulled; in the "fire" position, the trigger clears the recess in the pin and can be pulled to discharge the firearm. In such rifles, however, the firing pin may be free floating, with no safety mechanism acting on the firing pin. When chambering a round, the charging handle is pulled rearward to draw the bolt out of the chamber and allow a cartridge to be positioned for feeding to the breech. Upon releasing the charging handle, the bolt slides forward to battery and chambers the round. When the bolt is cycled forward and locked, the firing pin has the potential to move forward and hit the cartridge's primer, possibly resulting in an unintended discharge. Accordingly, when the bolt is released from the bolt catch while chambering a round, and prior to pulling back on the trigger, an unintentional discharge may result. Thus, there is a need for an improved firearm design configured to reduce unintended firing.

Embodiments of the present disclosure attempt to overcome limitations of certain safety mechanisms known in the art and relate to an apparatus and method for limiting or preventing unintentional discharge of a firearm. Embodiments of the present disclosure also relate to an apparatus and method for an improved operating system for small caliber rifles. Numerous configurations and variations will be apparent in light of this disclosure.

As will be seen, the devices and methods taught herein offer an improvement to firearm safety, particularly as applied to semiautomatic and automatic rifles, carbines, submachine guns, and machine guns. The devices and methods disclosed herein are intended to avoid unintentional discharge, as well as the consequences of firearm malfunctions. Improving firearm safety may help to eliminate or minimize the risks of unintentional death, injury or damage caused by improper handling of firearms. The devices and methods taught herein may help to improve firearm safety, including results of drop safety tests.

Figure 11A:
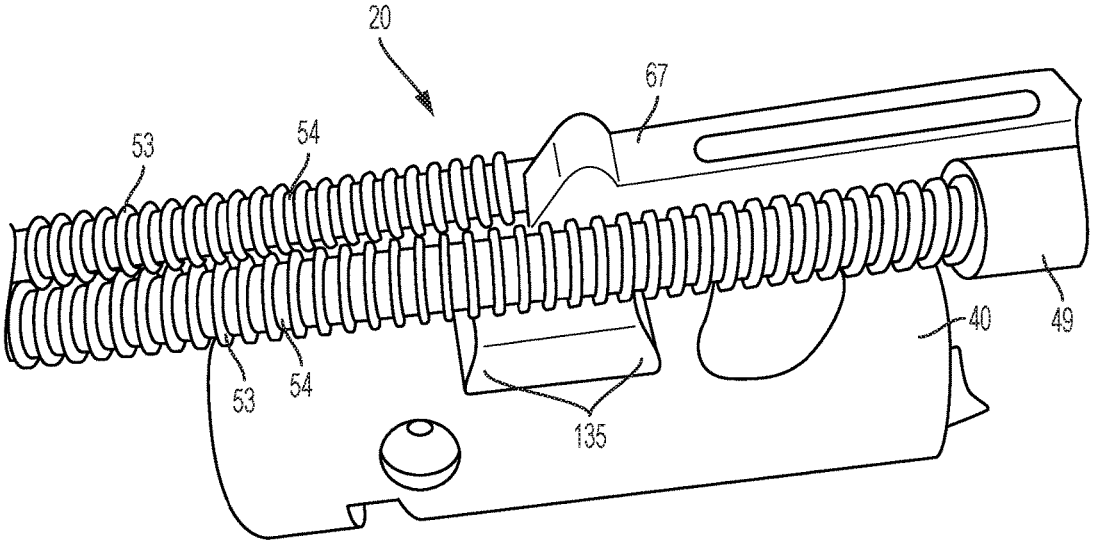
FIG. 11A PRIOR ART
FIG. 11A shows a conventional mechanism for mounting a recoil assembly to a carrier assembly using a dovetail join as known in the art.

As will be seen, the devices and methods taught herein offer an improved operating system for small caliber rifles. Pursuant to one aspect of the present disclosure, there is contemplated a firearm comprising a firearm receiver, a fire control group installed in the firearm receiver and comprising a carrier assembly, a recoil assembly, and a bolt assembly. The carrier assembly houses the bolt assembly and the recoil assembly may be positioned to engage the carrier and bolt assemblies during operation of the firearm. The operating system may contain an operation rod, herein referred to as an op-rod, which is pushed by a gas system during firing. During firing, gas pressure pushes the op-rod rearward to move the bolt carrier group rearward against spring forces. Oscillations may be induced through the gun, causing pitch excitation. In particular, if any components of the fire control group are misaligned, pitch excitation may occur as a result of a conventional connection between the carrier assembly and the recoil assembly (e.g., a dovetail joint as shown in FIG. 11A). Pitch excitation, as used herein, may be defined as movement or oscillations of the recoil assembly in a harmonic manner (e.g. flopping up and down or whipping around following firing). When pitch excitation occurs, it may be harder to eject the ammunition casing off of the bolt face since the recoil group may deviate from being parallel to the bore axis and apply torque to the bolt carrier group. The design as described herein eliminates or reduces pitch excitation by, for example, allowing rotation of the recoil assembly with respect to the carrier assembly at the pivoting interface. As a result, the recoil assembly applies less torque to the carrier group and more efficiently moves the bolt carrier group along the bore axis.

In the present disclosure, a pivoting interface is added toward a rear end of the op-rod, which is configured to absorb torque and eliminate moment forces which may otherwise cause friction load losses, joint failure, and/or wear to firearm components. In some cases, failure rates may be improved by a factor of three times, four times, or five times over conventional operating systems. The pivoting interface is configured to decouple non-axial motion in the recoil assembly from axial motion in the carrier assembly. At least in part due to the eliminating or reducing of moment forces resulting from firing, the pivoting interface is configured to provide a more consistent bolt-cartridge interface during firing, a firearm that operates with a smaller required gas volume to cycle the action, and a firearm that operates more efficiently using less energy. It should be noted that, while generally referred to herein as a 'pivoting interface' for consistency and ease of understanding the present disclosure, the disclosed pivoting interface is not limited to that specific terminology and alternatively can be referred to, for example, as a hinge joint or other terms.

The pivoting interface may comprise a recoil assembly rotation slot in the carrier assembly and a corresponding rounded surface on the recoil assembly. The rounded surface may be configured to rotate in the recoil assembly rotation slot following firing. It should be noted that, while generally referred to herein as a 'recoil assembly rotation slot' for consistency and ease of understanding the present disclosure, the disclosed recoil assembly rotation slot is not limited to that specific terminology and alternatively can be referred to, for example, as a keyway or other terms. As will be further appreciated, the particular configuration (e.g., materials, dimensions, etc.) of the pivoting interface and recoil assembly rotation slot configured as described herein may be varied, for example, depending on whether the target application or end-use is military, tactical, or civilian in nature. Numerous configurations will be apparent in light of this disclosure.

Embodiments of the present disclosure also relate to an apparatus and method for a firing pin lock. In some embodiments, the apparatus and methods taught herein offer a firing pin lock attached to an op-rod in the recoil assembly and comprising a firing pin catch. The firing pin catch may be configured to prevent the firing pin from moving forward and hitting the primer when not intended. In some embodiments, the firing pin catch may interface with the hammer during firing. The firing pin catch, the firing pin lever, or both may define a stop surface that engages the head of the firing pin. The firing pin catch, the firing pin lever, or both may prevent unintentional discharge of the firearm. When a user pulls back on the trigger, the firing pin lever is rotated, thus releasing the firing pin catch from engagement with the firing pin and causing release of the firing pin to strike the primer. In some embodiments, a return spring, a camming surface, or both may be included to bias the firing pin toward a resting state. In some embodiments, following release of ammunition, the return spring, the camming mechanism, or both, bias the firing pin back into a resting state.

In the present disclosure, an op-rod can be coupled to the bolt carrier. In some embodiments, a short stroke piston is used. With a short-stroke or tappet system, the piston moves separately from the bolt assembly. The piston may directly push the carrier assembly parts, such as in the M1 carbine, or it may operate through a connecting rod or assembly, such as in the Armalite AR-18 or the SKS rifle. In either case, the energy is imparted in a short, abrupt push and the motion of the gas piston is then arrested to allow the carrier assembly to continue through the operating cycle using kinetic energy. The short-stroke piston has the advantage of reducing the total mass of recoiling parts compared to the long-stroke piston. This, in turn, enables better control of the weapon, compared to firearms with long-stroke counterparts due to less mass needing to be stopped at either end of the bolt carrier travel.

Periodically with firearms, and in particular for firearms equipped with sound suppression, there is a need to periodically clean out built up carbon deposits in the firearm. With many firearms, it is necessary to perform several steps to remove the bolt assembly. For example, to remove the bolt, it may be necessary to first remove individual parts (i.e. a spring) and push in a pin. The embodiments disclosed herein can provide easy disassembly for cleaning, and can eliminate the need to remove or maneuver individual parts thereby creating a stronger bolt assembly interface. The embodiments disclosed herein eliminate the need to physically remove firing pin retention pin 58 from carrier assembly 40 prior to removal of the bolt assembly. Firing pin retention pin 58 is retained in connection with carrier assembly 40 and thereby reduces the potential for lost parts. Bolt assembly 30 is removed by disassembling interlocking components. Bolt 140 can be removed by sliding first pin retention pin 58 outwards (firing pin retention pin 58 is captured by carrier assembly 40 and does not become a loose part), removing firing pin 41 axially out a rear end of bolt assembly 30, removing a cam pin out of a cam pin receptacle, and pulling bolt 140 forward out of carrier assembly 40. Many of the embodiments disclosed herein are configured for a user to remove the bolt by removing the bolt in one assembly unit. The designs disclosed herein can take advantage of a reduced part count and provide for more efficient assembly and disassembly.

Turning now to the drawings example embodiments of the present teachings are discussed.

Bolt Assembly/Tapered Lug

Figure 2:
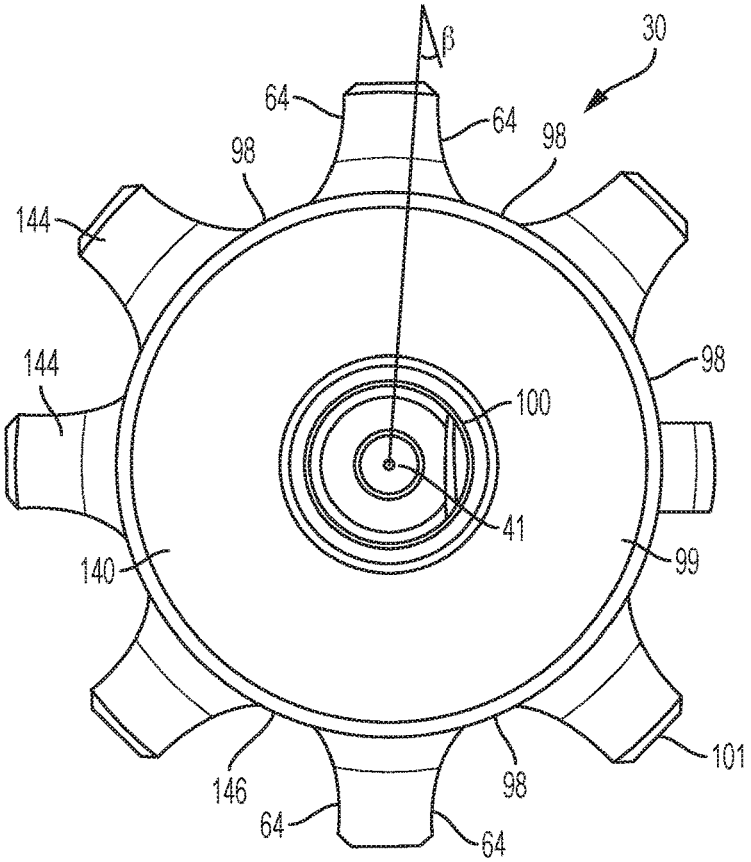
FIG. 2 shows a front-end view of a bolt assembly of the operating system for small caliber rifles in accordance with the present disclosure.
Figure 3:
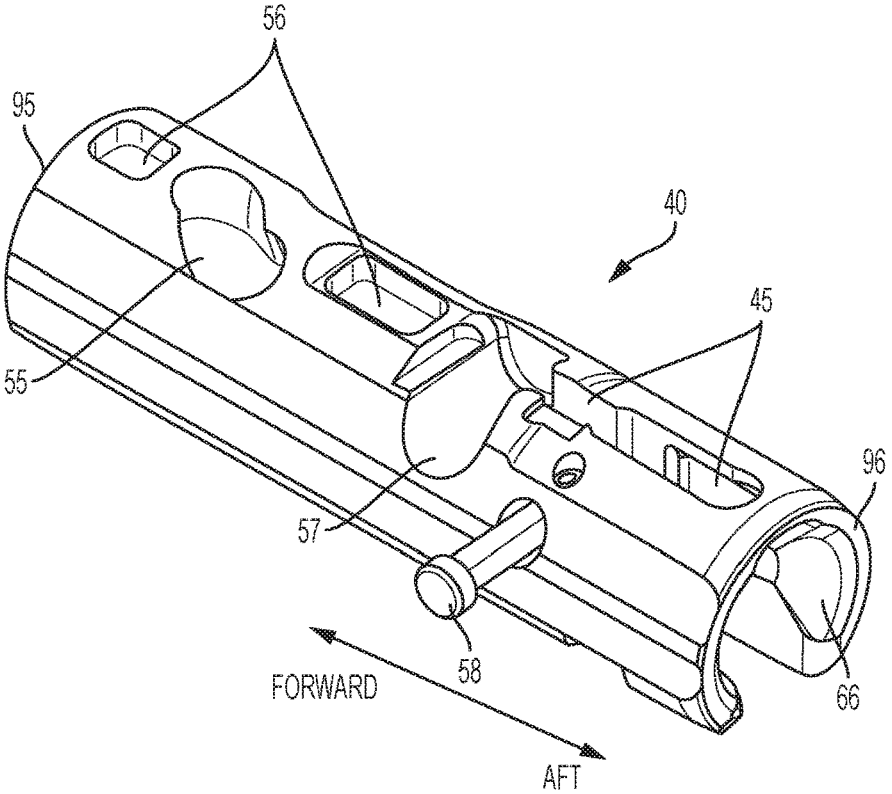
FIG. 3 shows a top, left-side, and rear perspective view of a carrier assembly of the operating system for small caliber rifles in accordance with an embodiment of the present disclosure.

Referring now to FIGS. 1-2, an elevational view and a front-end view, respectively, illustrate a bolt assembly 30 in accordance with an embodiment of the present disclosure. Bolt assembly 30 has a bolt 140 extending along a bore axis 5 to a forward end 93 that includes a set of radially extending lugs 144. Lugs 144 extend radially outward from an outside surface 98 of bolt 140 and are distributed circumferentially along outside surface 98. As best shown in FIG. 2, a bolt face 99 is defined radially inside the plurality of lugs 144 at forward end 93 of bolt body 151. Bolt face 99 defines a firing pin opening 100 for operation of firing pin 41 along the bore axis 5. In conventional bolt assemblies, the bolt lug can crack due to fatigue from extended use. As bolt 140 rotates, clearance is lost between lugs 144 and corresponding slots at the breech, resulting in wear and breakdown of components. In contrast, the design described herein incorporates tapering on one or both sides 64 of each lug 144 to increase clearance with slots in the breech and extend lifetime of the parts.

In one embodiment, each of the plurality of lugs 144 has sides 64 extending from a radial outside lug face 101 to outside surface 98 of bolt 140. Each of the plurality of lugs 144 can be tapered by a first angle $\alpha$ and/or a second angle $\beta$ as described below. In one embodiment, side(s) 64 of each of lugs 144 define a side taper angle $\beta$ from 5 to 20 degrees with respect to a radius extending from the center of bolt 140. Other values of side taper angle $\beta$ are acceptable, including 6, 7, 8, 9, 10, 11, 12, 13, 14, 15, 16, 17, 18, or 19 degrees. One or both sides 64 of each lug 144 can be tapered. In one embodiment, bolt 140 rotates according to the right-hand rule, so one side 64 of each lug is more prone to contact slots of the breech when moving into and out of battery. Thus, only one side 64 of each lug 144 may be tapered. Similarly, an opposite side 64 of lugs 144 is more prone to contact slots of the breech when bolt 140 rotates in an opposite direction. In another embodiment, each side 64 lugs 144 has a different side taper angle $\beta$, such as when one side 64 of a lug 144 has an increased side taper angle $\beta$ compared to the other side 64 of the same lug 144.

In addition to or as an alternative to side taper angle $\beta$, aft portion 147 of lugs 144 may be provided with an aft taper angle $\alpha$. Aft portion 147 of lugs 144 can extend in a straight line, stepped, or a curve from outer lug surface 101 to bolt body 151. Radial outer lug surface 101 can be rounded, flat, can include a chamfer or edge rounding. In some embodiments, lugs 144 can be curved extending from bolt body 151 to radial outer lug surface 101. In one embodiment, aft portion 147 extends generally in a straight line and has aft taper angle α that is greater than 90° to about 120° with respect to bore axis 5. Stated differently, aft taper angle α is from 1° to 30° with respect to an axis perpendicular to bore axis 5 in some embodiments.

In some embodiments, the side taper angle β and/or aft taper angle α may be constant along the taper. Alternatively, side taper angle β and/or aft taper angle α may vary along the length of the taper. Aft taper angle α may be at a constant angle of between 1° and 20°, between 12° and 18°, between 14° and 16°, or between 5° and 15° with respect to an axis perpendicular to bore axis 5. Alternatively, aft portion 147 of lugs 144 can be curved or stepped and the aft taper angle α may vary from an angle of between 0° and 90°, between 10° and 70°, or between 14° and 60° with respect to an axis perpendicular to bore axis 5. Side taper angle β may be a constant value from 1° to 20°, from 3° to 7°, or from 4° to 5° with respect to an axis perpendicular to bore axis 5. Alternatively, sides 64 of lugs 144 can be curved or stepped and angle β may vary from an angle of between 0° and 90°, between 10° and 70°, or between 14° and 60° with respect to the radius of bolt 140. In some embodiments, the radius of the curvature may be between ¼" and ½". At different points along the sides 64 of each lug 144 or along the aft portion of lugs 144, the radius can vary.

Lug 144 with tapered sides 64 and/or tapered aft portion 147 is configured to provide decreased stress and/or reduced wear resulting in a longer life of the bolt assembly 30 and operating system 10. Lug 144, when provided with tapered sides 64, is provided with the advantage of increased clearance and reduced friction with the extractor and/or with the complimentary shaped set of teeth (i.e. mating recesses) in the barrel. The design disclosed herein reduces friction between the set of lugs 144 on bolt assembly 30 and a set of teeth in the barrel caused during rotation. Functionally, sides 64 and/or aft portion 147 of lug 144 may be configured to increase an operating clearance with mating recesses or slots at a breach end of the barrel.

Carrier Insert

Figure 4:
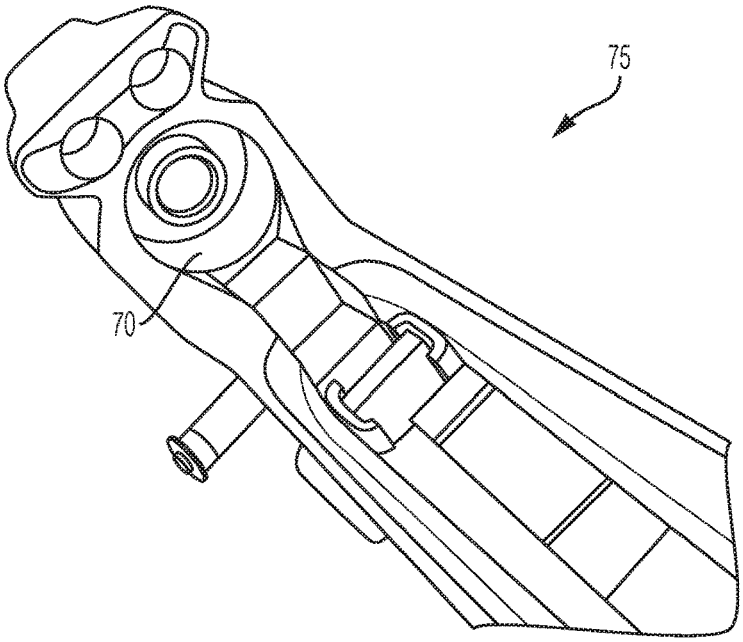
FIG. 4 shows a top and front perspective view of a rifle lower receiver in accordance with one embodiment of the operating system for small caliber rifles of the present disclosure.
Figure 5:
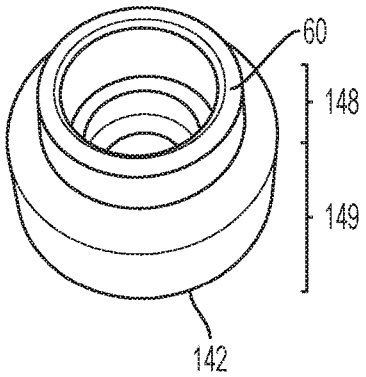
FIG. 5 shows a top and front view of an elastomeric insert for absorbing shock in accordance the operating system for small caliber rifles in accordance with an embodiment of the present disclosure.
Figure 6A:
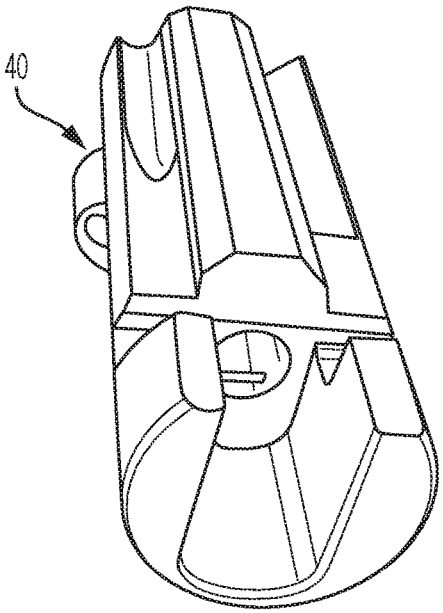
FIG. 6A (PRIOR ART)
FIG. 6A shows a bottom and rear perspective view of a conventional carrier assembly as known in the art.
Figure 6B:
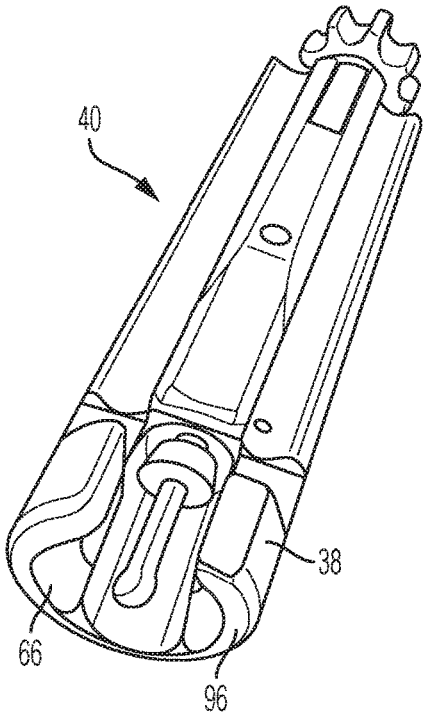
FIG. 6B shows a bottom and rear perspective view of a carrier assembly and firing pin of the operating system for small caliber rifles in accordance with an embodiment of the present disclosure.

Referring now to FIGS. 3-5, and 6A-6B, carrier assembly 40 is illustrated in accordance with another embodiment of the present disclosure. FIG. 4 shows receiver 75, including circularly shaped contact point 70. FIG. 5 shows a component view of an example elastomeric insert. FIG. 6B illustrates carrier assembly 40, including conical region 66 for mating with insert 60. For comparison, FIG. 6A illustrates a rear perspective view of an aft portion of a carrier of the prior art.

As disclosed herein, carrier 38 has an aft end 96 defining a conical region 66 and an insert 60 shaped to mate with conical region 66. Conical region 66 may be formed in an aft end 96 of carrier 38 (shown in FIGS. 3 and 6B). Conical region 66 may be formed with several individual wing shaped regions, wider at an aft end and narrower at a forward end. For example, conical region 66 may be a single wing shaped region or may be formed with 2, 3, 4, 5, or more individual wing shaped regions. Insert 60 (shown in FIG. 5) may be formed to have a conical or frustoconical shape to mate correspondingly with conical region 66. Insert 60 may be placed in conical region 66 between aft end 96 of carrier assembly 40 and contact point 70 of a lower receiver (shown in FIG. 4). Insert 60 can decrease the stopping force of the carrier 38 from recoil forces, reducing internal loads to the carrier assembly 40 and reducing the overall dynamic load. Insert 60 can provide a greater surface area at the interface between carrier assembly 40 and receiver 75 to allow for gradual deceleration of carrier assembly 40 as insert 60 is compressed.

Figure 18:
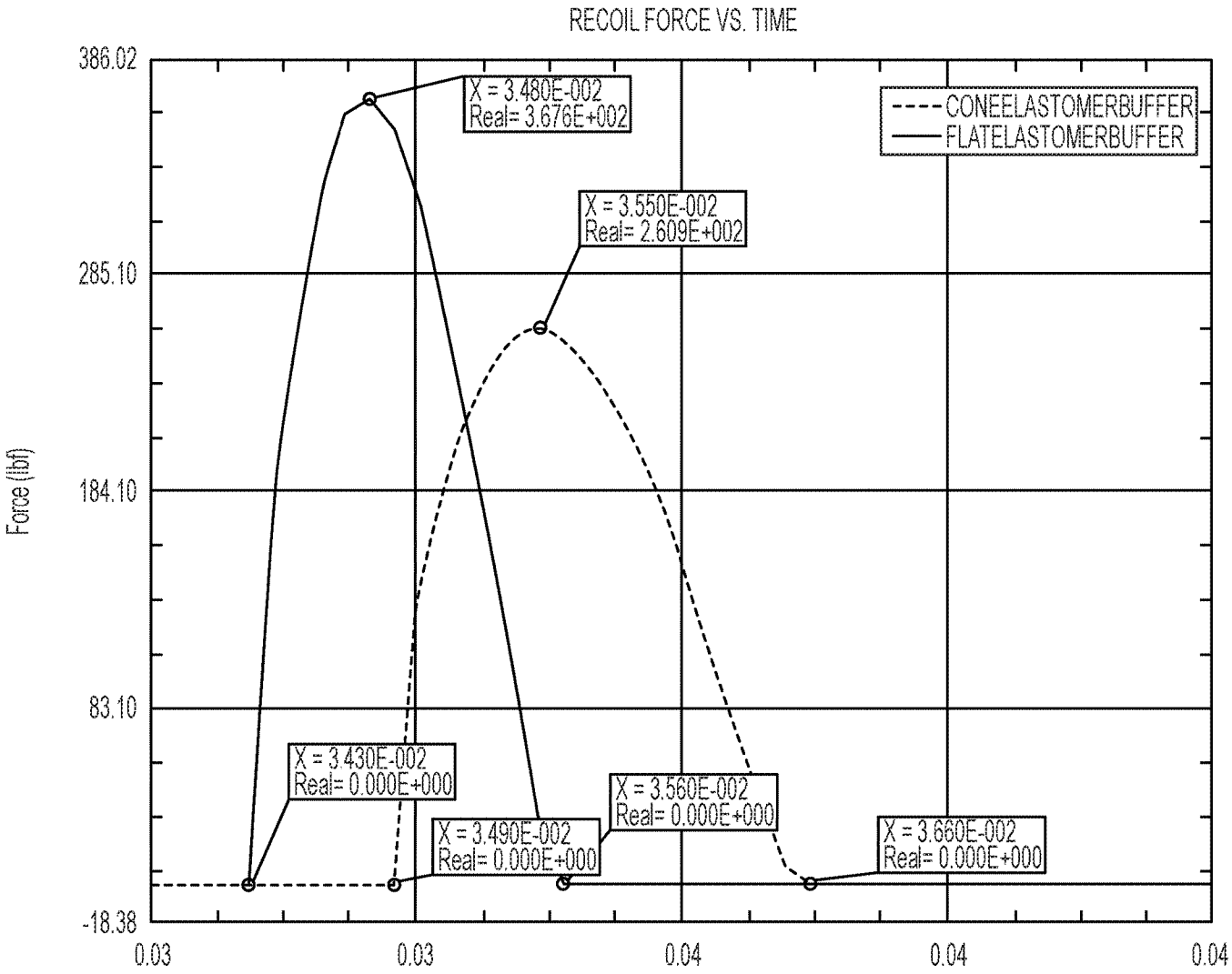
FIG. 18 shows a graphical representation of recoil force vs. time for a firearm configured with a cone elastomer buffer as compared to a firearm configured with a flat elastomer buffer.

Insert 60 may comprise an elastomer, a polymer, synthetic rubber, or the like, and may be configured to absorb energy, reduce recoil, or both. In various embodiments, insert 60 can have a Shore A hardness of from 15 to 110, and more specifically, from 90 to 100. Insert 60 is configured to provide for a smooth operation of firearm 200 by spreading recoil forces over a larger surface area, reducing the rate of deceleration, and absorbing recoil forces to result in a gentler impact. FIG. 18 illustrates the reduction in recoil forces vs. time of a conical or frustoconical shaped insert as compared to recoil forces vs. time for a flat insert. The peak force for the conical or frustoconical insert is shown as being about 260.9 lbf, while the peak force for the flat insert is shown as being about 367.6 lbf. In this example, the recoil forces have been shown to be reduced by about 29%. Different configurations may yield variations in exact recoil force reduction. Recoil force may be reduced by 10%, 20%, or 30% by utilizing the embodiments described herein. It should also be noted that a time delay is measured for the onset of detectable recoil force in the conical insert vs. the flat insert of 0.0007 seconds. Thus, the conical insert is configured to yield both a reduction in total recoil force and a delay in the onset of detectable recoil force as compared to the flat insert. Insert 60 is configured to spread and expand radially as force is applied axially thereto. Insert 60, conical region 66, and contact point 70 (shown in FIG. 4) are configured to provide a mechanical damping effect as the action of firearm 200 is cycled. Contact point 70 can be a circular recess in an aft end of the lower receiver 75. An inside circumference of insert 60 (shown in FIG. 5) may be formed with a stepdown region (i.e. with one region having an inside circumference greater than another region). Insert 60 can be formed with a flat surface perpendicular to bore axis 5 at aft end 142 of insert 60. A first portion 148 of insert 60 may be formed with an outside surface having a conical or frustoconical shape. A second portion 149 of insert 60 may be formed with an outside surface having a cylindrical shape.

Pivoting Interface

Figure 7:
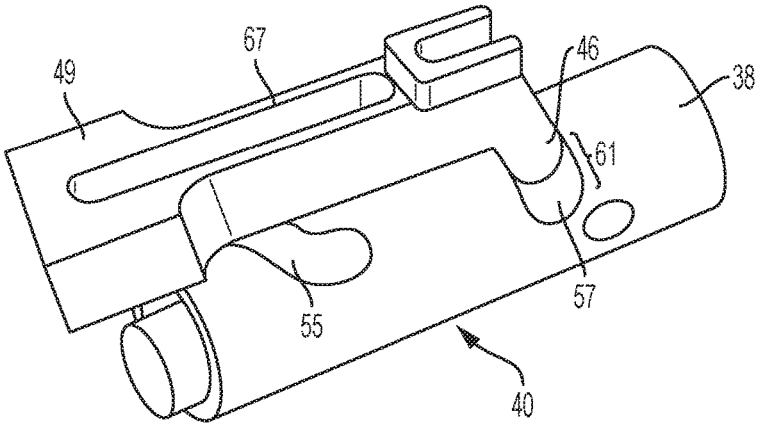
FIG. 7 shows a top, left-side, and front perspective view of a carrier assembly and recoil interface body of the operating system for small caliber rifles in accordance with an embodiment of the present disclosure.
Figure 8:
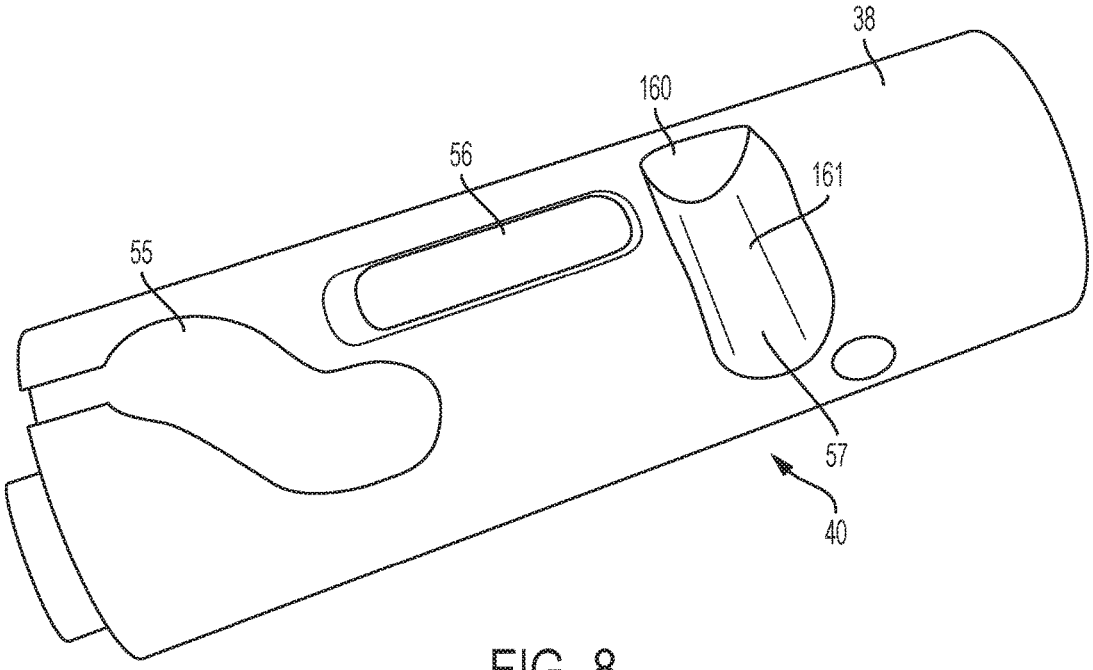
FIG. 8 shows a top and left-side perspective view of the carrier assembly of FIG. 7 showing a recoil assembly key slot in accordance with an embodiment of the present disclosure.

Referring now to FIGS. 7-8, top and left-side perspective views illustrate carrier assembly 40 in accordance with an embodiment of the present disclosure. FIGS. 7-8 show carrier assembly 40 and recoil assembly 20 and how the two interact with each other, including by pivoting interface 61. FIG. 7 includes a recoil interface body 67 installed on bolt carrier 38. In one embodiment, carrier 38 and recoil interface body 67 define a pivoting interface 61. In one embodiment, carrier 38 defines a recoil assembly rotation slot 57 configured to receive a rounded extension 46 on recoil interface body 67. Carrier 38 also includes one or more recoil assembly key slot 56 a firing pin safety guide slot 45, and a harmonic cam 55.

In one embodiment, pivoting interface 61 includes an extension 46 with a convexly rounded surface 85 corresponding to a concavely rounded bottom portion 161 of recoil assembly rotation slot 57 defined in a top surface of carrier 38. Recoil assembly rotation slot 57 has a rounded profile that extends partially through carrier 38 in a direction perpendicular to bore axis 5. As such, recoil assembly rotation slot 57 has an open top and defines a flat surface 160 at a blind end and rounded bottom portion 161.

Pivoting interface 61 may be positioned toward a rear end of the op-rod 50, and acts as a connecting point transferring force between recoil assembly 20 and carrier assembly 40. Pivoting interface 61 is configured to provide a consistent bolt-cartridge interface during firing, operates using a smaller required gas volume, and operates more efficiently since it requires less energy. Following firing of ammunition, forward end 91 of recoil assembly 20 may move in an upward direction due to recoil effects. Pivoting interface 61 directs recoil energy axially toward aft end 172 of firearm 200 and downward against carrier 38. Rounded extension 46 allows free rotation of recoil assembly 20 along median plane 7 with respect to carrier assembly 40, thereby eliminating pitch excitation of carrier assembly 40. In other embodiments, pivoting interface 61 is hinged rather than a pivoting or rotating interface. In some embodiments, pivoting interface 61 is configured for rotational motion about a pivot point. In other embodiments, recoil interface body 67 can rotate about a pin located centrally in rounded extension 46.

Recoil assembly rotation slot 57 may provide a surface on which rounded extension 46 pivots on recoil assembly 20. Recoil assembly rotation slot 57 may be formed by cutting with a cylindrical die, for example, a region out of a top portion of carrier assembly 40. Flat surface 160 or blind end may be formed at one lateral end, with a rounded recoil assembly rotation slot 57 extending laterally to the opposite lateral end, as shown in FIG. 8.

Functionally, pivoting interface 61 is configured to absorb torque and reduce moment forces resulting from recoil effects during firing. In doing so, pivoting interface 61 may provide stability in a direction perpendicular to bore axis 5 by preventing or reducing upward forces exerted on carrier 38 by recoil assembly 20. Pivoting interface 61 therefore reduces frictional load losses, joint failure, and/or wear to firearm components. One advantage provided by the use of pivoting interface 61 described herein is that it allows the recoil assembly 20 to move more naturally in response to firing of ammunition and better transfers forces axially to carrier assembly 40.

Recoil Assembly

Figure 9:
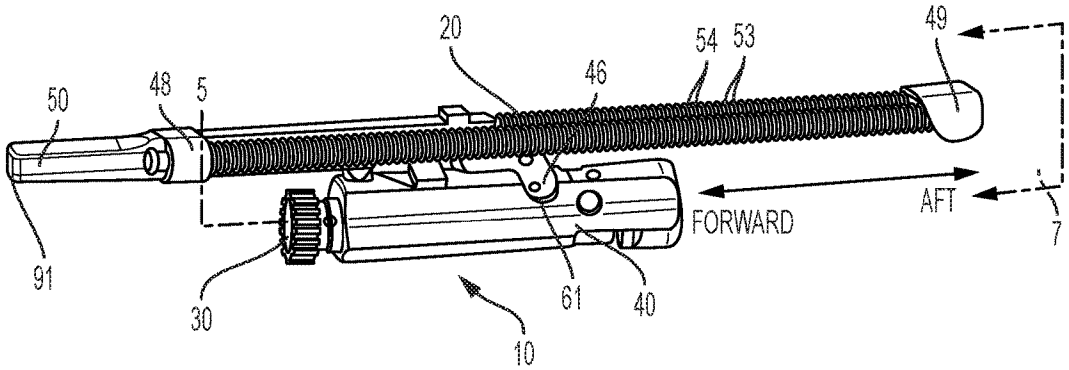
FIG. 9 illustrates a top, left-side, and front perspective view of a recoil assembly and bolt carrier group of the operating system for small caliber rifles in accordance with an embodiment of the present disclosure.
Figure 10:
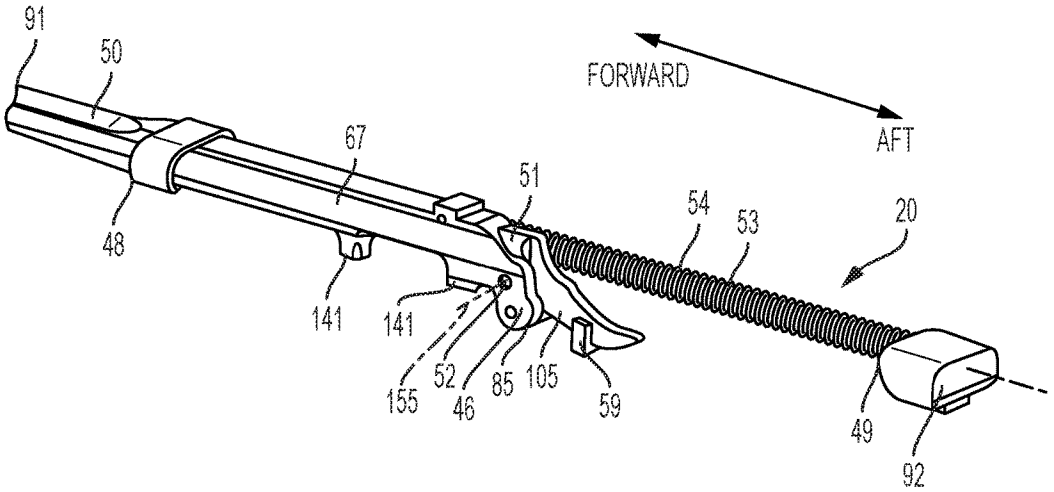
FIG. 10 shows a top, left-side, and rear perspective view of a recoil assembly of the operating system for small caliber rifles in accordance with an embodiment of the present disclosure.
Figure 11B:
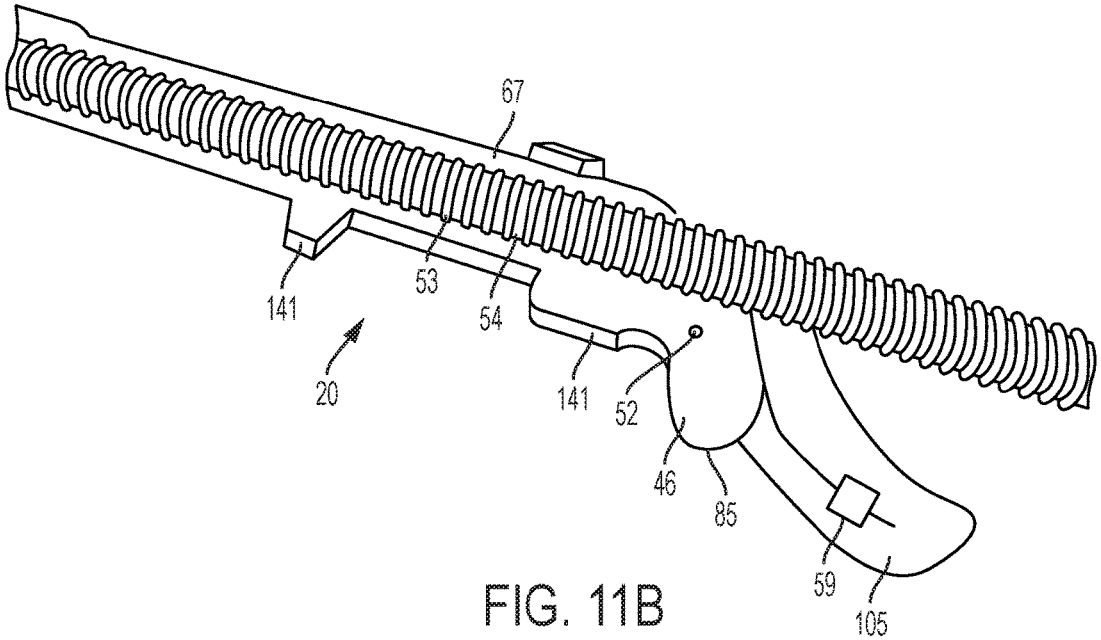
FIG. 11B shows a top, left-side, and rear perspective view of a recoil assembly with part of a pivoting interface of the operating system for small caliber rifles in accordance with an embodiment the present disclosure.

Referring now to FIGS. 9, 10, and 11B, a recoil assembly 20 is illustrated in accordance with an embodiment of the present disclosure. FIG. 9 is a left-side perspective view illustrating details of components of an operating system 10 described herein and shows recoil assembly 20 assembled with carrier assembly 40 and bolt assembly 30 using pivoting interface 61 as discussed above. Some of the components illustrated in FIG. 9 form part of fire control group 145 shown in FIGS. 14A-14C discussed below. FIGS. 10 and 11B illustrate right-side perspective views of recoil assembly 20 showing firing pin lever 105 pivotably attached to recoil interface body 67 with lever retaining pin 52. For comparison, FIG. 11A illustrates a dovetail joint 135 as used in the prior art between carrier assembly 40 and recoil assembly 20.

Figure 12:
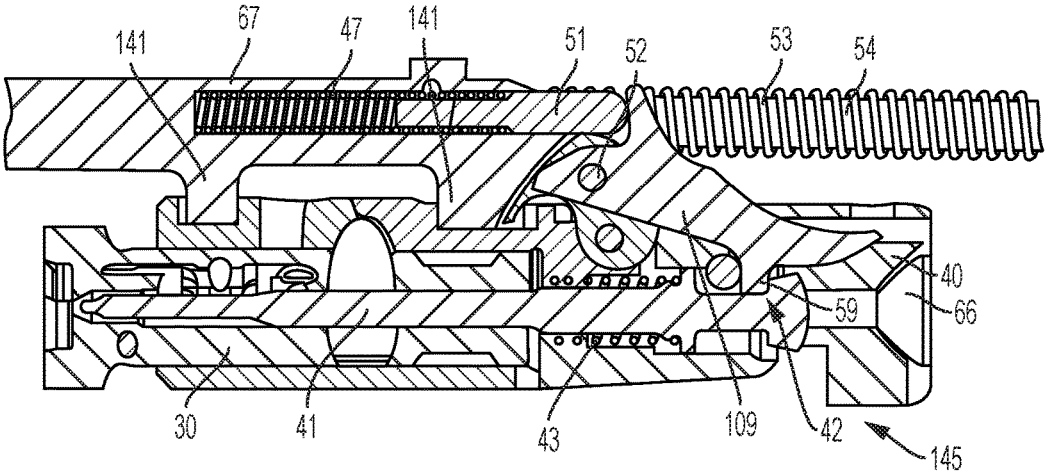
FIG. 12 illustrates a left-side elevational section of part of a fire control group and recoil assembly of the operating system for small caliber rifles in accordance with one embodiment the present disclosure.

Recoil assembly 20 of the present disclosure is configured to absorb recoil forces and/or energy resulting from firing and move carrier assembly 40 axially rearward in response to cycle the action of firearm 200. In one embodiment, recoil assembly 20 includes at least one return plunger 51 with a plunger return spring 47, and one or more recoil springs 53 each installed along a guide rod 54. Plunger return spring 47 and return plunger 51 are also illustrated in FIG. 12. A forward spring retainer 48 can be positioned on a forward end 91 of the recoil assembly 20, and an aft spring retainer 49 can be positioned on an aft end 92. The recoil assembly 20 also includes an op-rod 50, a lever retaining pin 52, and firing pin lever 105 with a firing pin catch 59. Recoil assembly 20 can be configured with tabs 141 which engage recoil assembly key slots 56 (shown in FIG. 3) in carrier assembly 40 to provide a stiff rotational interface that resists rotation of carrier assembly 40 about bore axis 5 when bolt 140 rotates. Bolt 140 rides in a short carrier 38 to allow translation and rotation of bolt 140 by harmonic cam 55 without lost motion. The connection between tabs 141 and key slots 56 (shown, for example, in FIG. 9) prevents the bolt 140 from hitting the chamber wall while entering or exiting the chamber of firearm 200. Accordingly, reducing this type of frictional force provides more efficient operation.

As best shown in FIGS. 9 and 11B, one embodiment of recoil assembly 20 comprises two recoil springs 53 extending in a spaced-apart generally parallel relationship. Each recoil spring 53 is installed concentrically along a recoil guide rod 54 and maintained in position between forward spring retainer 48 and aft spring retainer 49. In some embodiments, recoil springs 53 and guide rods 54 extend along opposite sides of recoil interface body 67 that includes aft spring retainer 49, pivoting interface 61, and tabs 141. As shown in FIG. 10, a set of springs may be included in recoil assembly 20. The set of springs may include a primary spring or plunger return spring 47 (shown in FIG. 12) acting on return plunger 51 and a secondary spring or recoil spring 53 acting on op-rod 50 between forward spring retainer 48 and aft spring retainer 49.

As illustrated herein, recoil assembly 20 includes pivoting interface 61 as discussed above to allow upward rotation of op-rod 50 along a median plane 7 relative to carrier assembly 40. The rotation of recoil assembly 20 with respect to carrier 38 is minimized once recoil assembly 20 is inserted into a firearm 200. When installed in firearm 200, pivoting interface 61 serves primarily to absorb moment forces resulting from firing and translate carrier assembly 40 axially along bore axis 5 with little or no rotational deviation from bore axis 5.

Firing Pin Lock

Figure 13:
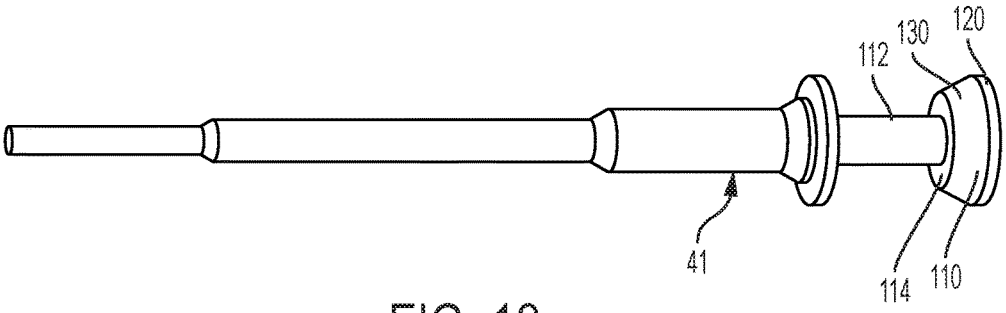
FIG. 13 shows a left-side elevational view of a firing pin of the operating system for small caliber rifles in accordance with one embodiment of the present disclosure.
Figure 14A:
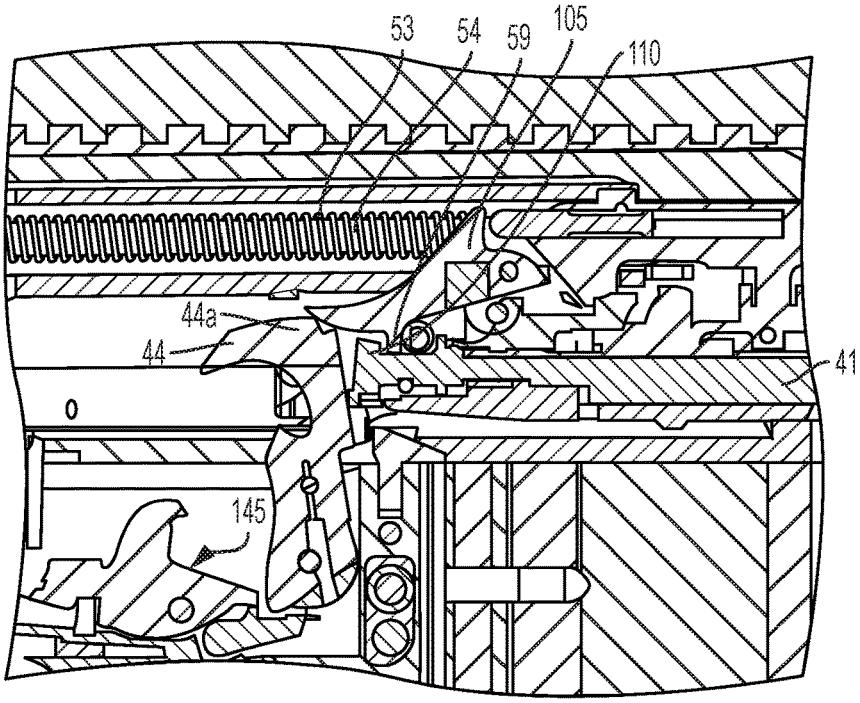
FIGS. 14A-14C show a firing pin lock and fire control group of the operating system at various stages of operation, in accordance with an embodiment of the present disclosure.
Figure 14B:
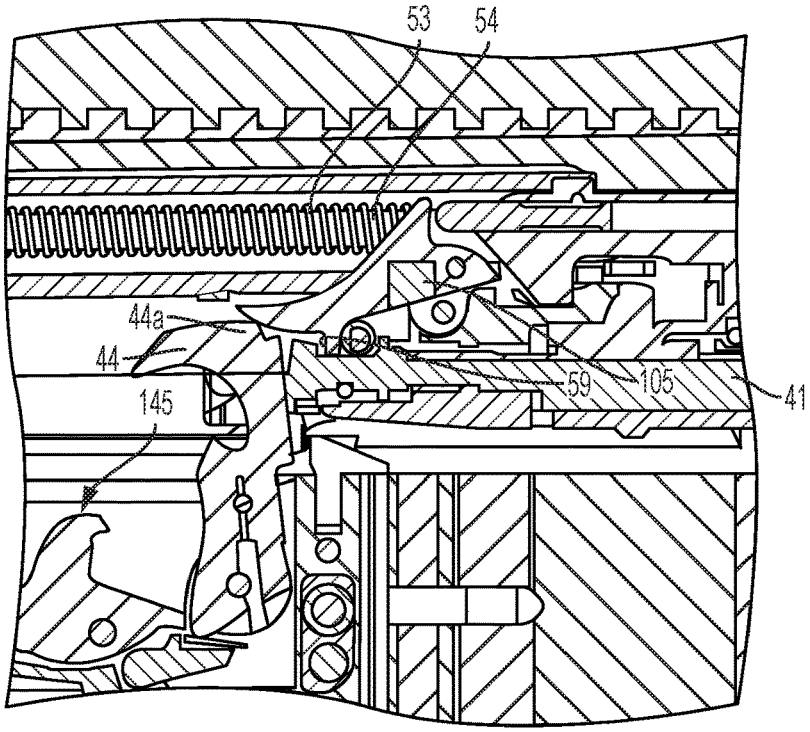
Figure 14C:
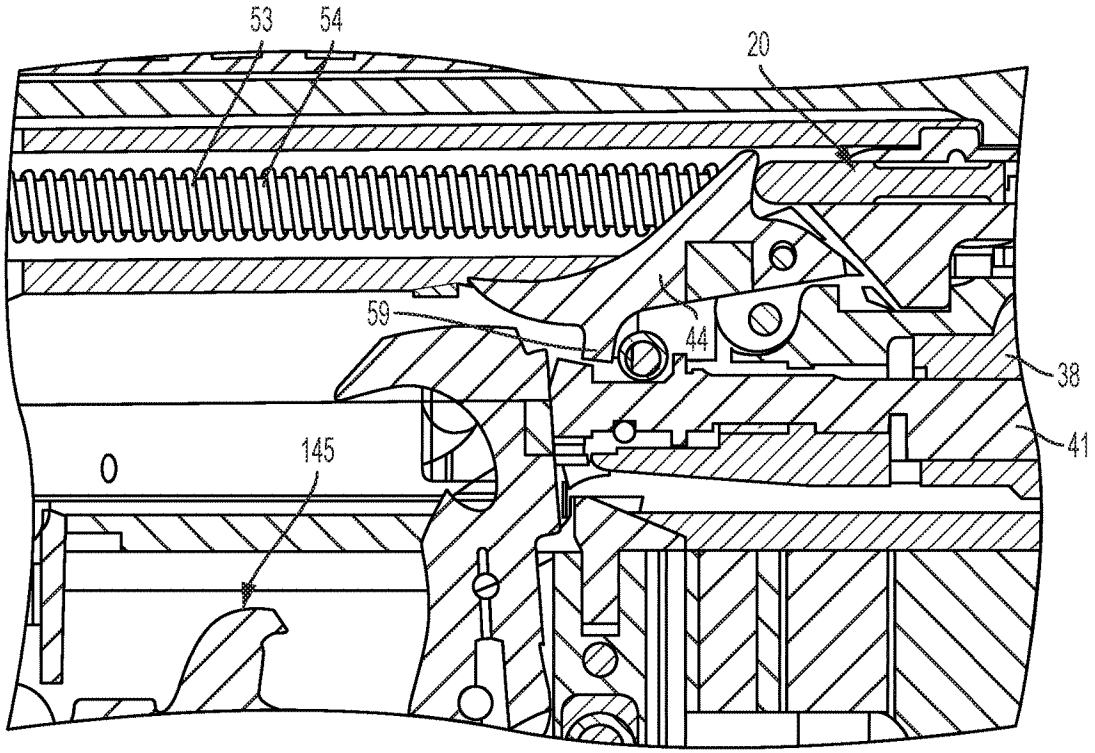

Another aspect of the present disclosure is directed to a firing pin lock 109 with a firing pin catch 59. FIG. 12 illustrates a left side sectional view showing bolt assembly 30 with firing pin 41, carrier assembly 40, and components of recoil assembly 20 in accordance with an embodiment of the present disclosure. FIG. 13 illustrates a side elevational view of firing pin 41 in accordance with an embodiment of the present disclosure. FIGS. 14A-14C illustrate the position of hammer 44, firing pin lever 105, and firing pin catch 59 at various points during the firing sequence.

In one embodiment, firing pin lever 105 is a component of recoil assembly 20 and includes firing pin catch 59. For example, firing pin lever 105 can be built into or pivotably attached to op-rod 50. In one embodiment, firing pin lever 105 is pivotably attached to recoil assembly 20 and includes firing pin catch 59 extending therefrom. Firing pin catch 59 is configured to prevent the firing pin 41 from inadvertently moving forward and hitting the primer. When recoil assembly 20 is installed in carrier assembly 40, firing pin catch 59 extends to engage firing pin 41 and prevents firing pin 41 from moving forward. Accordingly, firing pin catch 59 prevents firing pin 41 from inadvertently hitting the primer during normal operation and when firearm 200 is dropped.

Referring to FIG. 13, a side illustration shows firing pin 41 including a camming mechanism 130 at the head 110 of firing pin 41 in accordance with an embodiment of the present disclosure. Firing pin 41 includes a head 110 on an aft end. Head 110 is adjacent a narrowed region 112 that defines a catch surface 114 at a forward face of head 110.

Firing pin catch 59 engages catch surface 114 of firing pin 41 to prevent forward motion until the trigger is pulled.

FIG. 12 illustrates an internal configuration of the firing pin lock 109 in a resting state. Firing pin catch 59 occupies the space defined by narrowed region 112 of firing pin 41 and abuts catch surface 114. Thus, firing pin catch 59 blocks firing pin 41 from forward movement. FIGS. 14A-14C illustrate a stepwise progression of component movement during firing.

FIG. 14A illustrates the fire control group 145 after pulling the trigger, where hammer 44 is rotating forward and about to strike head 110 of firing pin 41. When the trigger is pulled, hammer 44 rotates forward toward firing pin 41, an end portion 44*a* of hammer 44 contacts firing pin lever 105, thereby starting to pivot firing pin catch 59. FIG. 14B illustrates firing pin lever 105 deflected upwards as hammer 44 contacts head 110 of firing pin 41. As shown in FIG. 14C, firing pin lever 105 and firing pin catch 59 have been deflected upward out of engagement with firing pin 41, which is then no longer obstructed from moving forward to strike the primer and discharge firearm 200.

After firing firearm 200, firing pin return spring 43 (shown in FIG. 12) causes the firing pin 41 to reset toward the rear, thereby allowing the firing pin catch 59 to occupy narrowed region 112 of firing pin 41 where it is positioned to prevent forward motion of firing pin 41 until the trigger is pulled again. Rearward motion of firing pin 41 is stopped by firing pin retention pin 58 extending into carrier 38 (shown in FIG. 3). Also after firing, hammer 44 pivots down to return to the cocked position and providing space for firing pin lock 109 to move down and back into position to hold back firing pin 41.

In some embodiments, firing pin return spring 43 may be included to bias firing pin 41 aft toward a resting state. Firing pin return spring 43, shown in FIG. 12, ensures that firing pin 41 is positioned aft and secured behind firing pin catch 59 prior to firing. Alternatively, in some embodiments, a camming mechanism may be used to bias firing pin 41 toward a resting state. For example, head 110 of firing pin 41 (shown in FIG. 13) may have a forward portion formed as a camming surface 130 to bias firing pin 41 toward a resting state and an aft portion formed as a stop surface 120. In a resting state, stop surface 120 is positioned against a bottom surface of firing pin catch 59. Following release of a round, camming surface 130 biases firing pin 41 back into a resting state.

Hollowed-Out Piston

Figure 15:
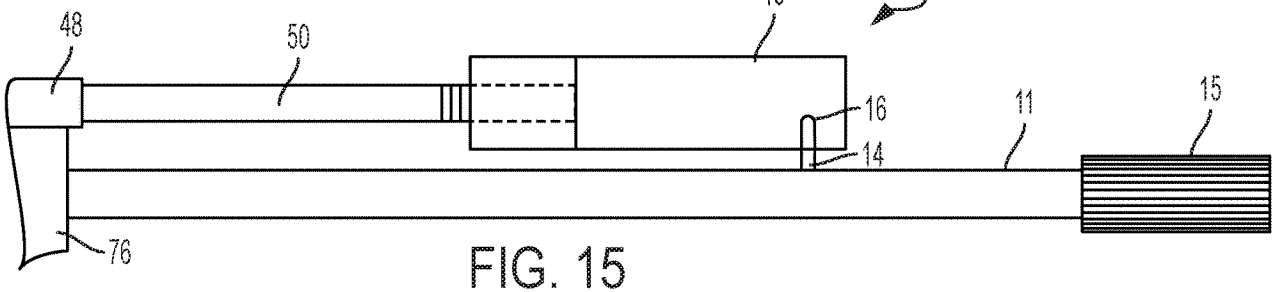
FIG. 15 illustrates a side elevational view of a hollowed-out piston and gas system in accordance with an embodiment of the present disclosure.
Figure 16:
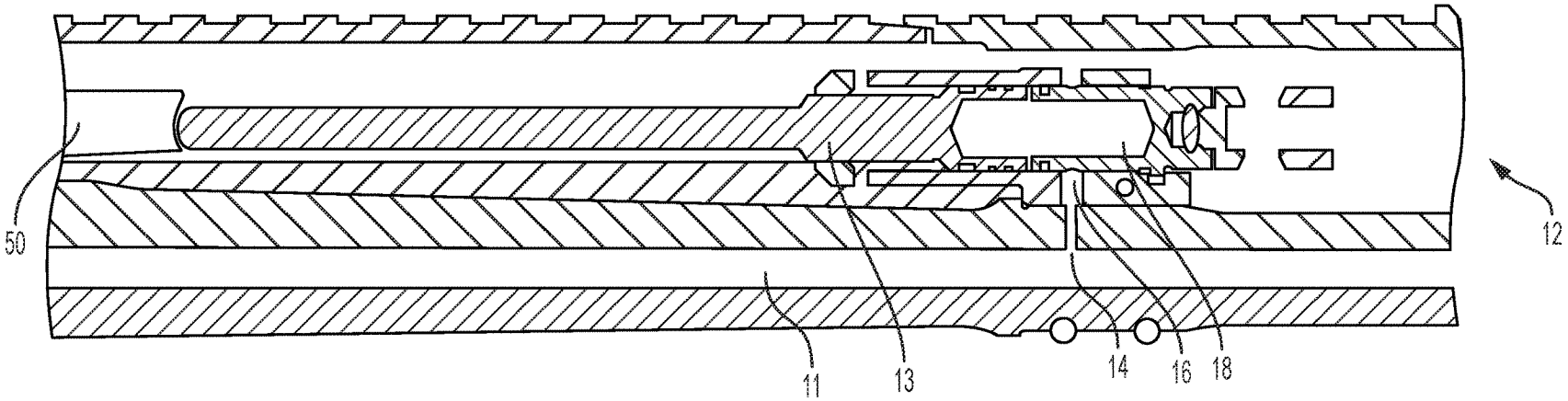
FIG. 16 illustrates a cross-sectional view of a hollowed-out piston and gas system in accordance with an embodiment of the present disclosure.

In some cases, it may be desirable to increase the volume in the gas system, particularly in firearms that are equipped with suppressors. Referring to FIGS. 15 and 16, which show a side elevational view and cross-sectional view, respectively, an example of a gas system 12 in accordance with an embodiment of the present disclosure is illustrated. In one aspect, a hollowed-out piston 13 is provided with firearm 200. A gas block 14 and gas manifold 16 direct propellant gases from barrel 11 into piston 13. The hollowed-out piston 13 is configured to maximize volume in the gas system 12, which in turn requires a longer stroke to operate the weapon. This results in lower loads and delays moving the bolt to the rearward position to open the chamber. The delayed opening of the chamber provides more time for propellant gases to expand through the suppressor 15 and therefore improves suppressor performance. The hollowed-out piston 13 can also provide more space for a gas valve 16. Gas can move from barrel 11 into the space created in hollowed-out cavity 18 in piston 13. The larger available volume allows for more time to reach a given pressure; this delay allows gas to bleed out of barrel 11. Embodiments described herein provide the advantages of a slower movement of gas through the gas system which does not accelerate parts faster than may be desired. A hollowed-out piston 13 can be, for example, a cylinder that is closed at one end and that receives the op-rod 50 through an opening in an opposite end. Hollowed-out cavity 18 may have a volume greater than 10%, 20%, 30%, 40%, 50%, or 60% or more of the volume of the piston. Propellant gases are directed to expand into the hollowed-out cylinder 13 and provide pressure sufficient to move op-rod 50 rearward to open the chamber.

Figure 17:
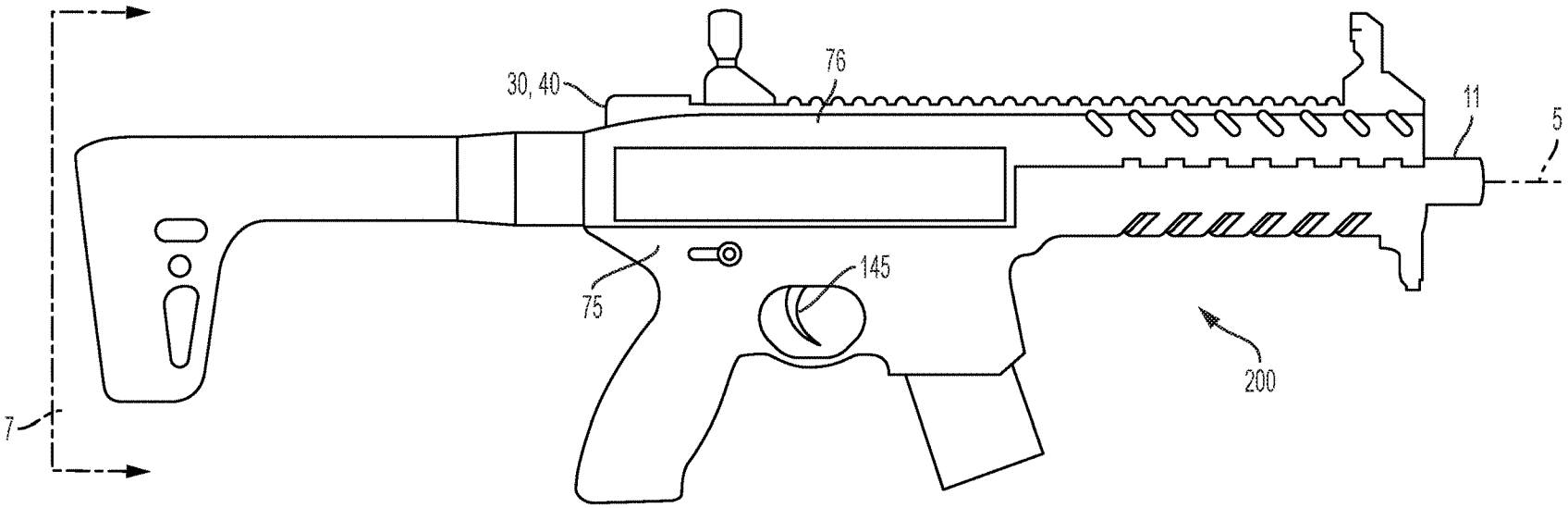
FIG. 17 shows a side elevational view of a firearm, in one embodiment of the disclosure.

FIG. 17 illustrates an example firearm 200 that could be configured with the operating system described herein. Firearm 200 includes lower receiver 75 housing the fire control group 145 and an upper receiver 76 housing recoil assembly 20 and the bolt carrier group that includes bolt assembly 30 and carrier assembly 30.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An operating system for a firearm, the operating system comprising:
- a firing pin; and
- a recoil assembly comprising:
  - an op-rod;
  - a firing pin lever attached to the op-rod, the firing pin lever configured to prevent the firing pin from moving forward to strike an ammunition primer unless a trigger is in a firing position; and
  - a plunger return spring configured to expand and contract along a longitudinal axis of the firearm, the plunger return spring configured to bias the firing pin lever to engage the firing pin toward a resting state.

2. The operating system of claim 1, wherein the firing pin lever is displaced by a hammer of the firearm in response to the trigger being pulled to the firing position, thereby allowing the firing pin to move forward.

3. The operating system of claim 2, wherein the firing pin lever is configured to rotate about a pivoting interface.

4. The operating system of claim 3, wherein the pivoting interface is configured to absorb moment forces resulting from firing.

5. The operating system of claim 1, wherein the plunger return spring is configured to act on a return plunger.

6. The operating system of claim 5, wherein the return plunger is configured to move in a direction parallel to the longitudinal axis of the firearm.

* * * * *